US006484760B1

(12) United States Patent
Muchin et al.

(10) Patent No.: US 6,484,760 B1
(45) Date of Patent: Nov. 26, 2002

(54) CONTAINER LOADER LEDGE

(76) Inventors: Jay Z. Muchin, 712 N. 11th St., Manitowoc, WI (US) 54220; David J. Merten, 4019 Goodwin Rd., Manitowoc, WI (US) 54220

( * ) Notice: Subject to any disclaimer, the term of this patent is extended or adjusted under 35 U.S.C. 154(b) by 0 days.

(21) Appl. No.: 09/569,177

(22) Filed: May 11, 2000

(51) Int. Cl.[7] ..... B65B 1/04

(52) U.S. Cl. ..... 141/2; 141/363; 141/364; 141/365; 141/366; 141/375

(58) Field of Search ..... 141/2, 363, 364, 141/365, 366, 375, 311 R, 319, 391; 68/17 R

(56) References Cited

U.S. PATENT DOCUMENTS 3,974,667 A * 8/1976 Gakhar ..... 134/100.1
4,489,765 A * 12/1984 Yamada et al. ..... 141/1
5,549,227 A * 8/1996 Klotz ..... 222/461
5,836,180 A * 11/1998 Herman-Latack et al. .. 68/17 R

* cited by examiner

*Primary Examiner*—Timothy L. Maust
(74) *Attorney, Agent, or Firm*—Ryan Kromholz & Manion, S.C.

(57) ABSTRACT

A fitment adapted to cover and reinforce an exposed edge of a container and facilitate the loading of the container with material. Alternatively, the fitment may be integrally formed with the container to be filled. The fitment includes a generally planar surface having a peripheral edge and an apertured cover hingedly attached thereto. A loading ledge, able to support heavy material to be loaded, is provided when the apertured cover is in the open position. The peripheral edge further includes a ramped portion to support the opened cover and heavy material. Apertures in the fitment allow passage of material from the ledge into the container.

19 Claims, 13 Drawing Sheets

CONTAINER LOADER LEDGE

BACKGROUND OF THE INVENTION

The present invention relates generally to support surfaces for loading a material or composition of materials into a container or for resting a material or composition of materials on a container so that they may be easily sorted or more easily transferred and/or deposited into the container. The invention more particularly relates to a fitment adapted to receive and support a load, e.g., a heavy bag or other container, during loading or transfer of material into the container proper.

The invention is believed to have application to all situations where it would be beneficial to rest the material to be placed into a container prior to placement in the container. Examples of such situations include, but are not limited to heavy loads of aggregate material that are to be measured into the container, loads of material that are to be sorted, fill and/or transfer prior to placement or deposit in the container or material that is to be mixed. Specifically, but not by way of limitation or exclusion of other applications, the present invention has application with containers like brine tanks. Some containers, such as brine tanks for regenerating the material used in water softeners, are periodically loaded with material, such as bagged rock salt crystal or pellets, that must be lifted from a lower level to the level of the container opening. This task is often difficult and cumbersome because of the weight of the material. The container walls are easily buckled during loading as the person loading rests the material-containing bag on the container opening edge.

SUMMARY OF THE INVENTION

The present invention specifically addresses and alleviates the above-noted problems associated with filling a container with heavy or cumbersome material as well as any load that may be temporarily rested prior to being transferred into a container. More particularly, a loader ledge fitment for water softener containers and the like is disclosed, which comprises an outer periphery configured to receive and fit over at least one portion of the container opening. Alternatively, the fitment may be integrally formed with the container to be loaded. The loader ledge provides a perforated cover through which the material may be poured, and a hinged cover which, while in the open position, provides a ledge for resting the material while being deposited. After the material (for example softener salt in the case of a water softener) has been poured into the container, the hinged ledge is rotated to the closed position. Further, the conventional lid supplied by the container manufacturer may be used in conjunction with the present loader ledge fitment when the container is not being loaded.

Alternatively the present invention may be summarized as a fitment for use with or integrally formed with a container for receiving a load of material comprising a supporting perforate or imperforate web and opening. The fitment having a shape substantially conforming to a contour of the container with which the fitment is to be used. The supporting web being circumjacent to the opening and including a ramp structure having a downward slope extending toward the opening. The supporting web including a surface for supporting the load of material. Whereby the load of material may be placed on the surface and a predetermined portion of the load of material may be transferred through the opening into the container.

Additionally the fitment may further include at least one channel having curb structures and the container may include at least one edge structure having a predetermined shape. The channel may substantially conform to the predetermined shape of the edge structure and extend along and engage a predetermined portion of the edge structure. The fitment may also include at least one bracket structure having at least a first end removably engagable with an exterior surface of the container and at least a second end coupled to the supporting web. The fitment may also include a bracket structure having at least one lockable collapsible lever mechanism.

In another alternative embodiment the fitment may include a supporting web, an opening, and a channel for use in combination with a container having at least one open end including at least one edge structure. The channel in this embodiment is engagable with the edge structure and the fitment includes a slot having an opening. The supporting web is capable of being extended and retracted through the slot so that when the supporting web is extended through the slot the opening is presented.

Additionally, the supporting web may have a retracted position and an edge and the fitment may include an inner wall and the container edge is capable of abutting the inner wall. Further, the supporting web may include a key structure and the opening may include at least one edge capable of engaging the key structure. Additionally, the supporting web may include at least one opening.

Another alternative of the present invention may be described as a fitment for use with a container for receiving a load of material, the fitment including a supporting web, a hinge structure and a channel. The container having at least one open end including at least one edge structure. The channel is engagable with the edge structure and the fitment is hingedly coupled to the supporting web at the hinge structure. The supporting web includes a stop structure and the fitment includes an abutment structure. The stop structure is engagable with the abutment structure such that engagement of the stop structure with the abutment structure places the supporting web in position to receive a load. Further, the fitment may be integral to the edge of the container.

In another alternative embodiment the present invention may be summarized as a fitment for use with a container for receiving a load of material, the fitment comprising a supporting web, a slot, a hinge mechanism and a channel. The container having at least one open end including at least one edge structure. The channel engagable with the edge structure. The fitment including a slot. The supporting web rotatably coupled to the fitment at the hinge mechanism. The slot having sufficient size and spatially orientation so that the supporting web may be rotated on the hinge mechanism and extended out of the slot and retracted back through slot. Whereby when the supporting web is extended through the slot the opening is presented and when the supporting web is retracted through the slot the open end is closed and the container is covered.

Further, the supporting web may include an opening spatially orientated on the supporting web so that a user may grasp the opening to aid in extending the supporting web through the slot. Also, the fitment may be integral to the edge of the container.

Another alternative embodiment of the present invention may be summarized as including a fitment for use with a container for receiving a load of material, the fitment comprising a supporting web surface and a channel. The container having at least one open end including at least one edge structure. The channel engagable with at least one portion of the edge structure. The channel located on a first fitment surface substantially opposite the supporting web surface.

Further, the channel may include a plurality of curb structures having a predetermined pitch and which are spatially orientated to impart a predetermined angle to the channel. Accordingly, the fitment may be removed from covering the container and the channel may be engaged with at least one portion of the edge so that the supporting web surface and at least a portion of the open end are presented for receiving the load of material.

Another alternative embodiment of the present invention may be summarized as a fitment for use with a container for receiving a load of material with the fitment comprising a hinge structure, a bearing pin structure, a supporting web surface, a bracket, and a channel. The container having at least one open end including at least one edge structure. The bearing pin structure mounted to the container. The channel engagable with at least one portion of the edge structure. The channel located on a first fitment surface substantially opposite the supporting web surface. The fitment including an inside rim surface. The container includes an inside surface. A lockable collapsible bracket coupled to the inside rim surface at the hinge structure and to the container at the bearing pin structure. The bearing pin structure slidably engaged with the bracket. The fitment pivotally coupled to the bracket at hinge structure. Accordingly, in this embodiment the fitment may be lifted off of the edge of the container until the bearing pin structure engages a distal end stop structure of the bracket.

Alternatively, the present invention may be generally summarized as a method of transferring a material into a first container from a second container, and wherein the material and its second container is lifted or placed from a lower level to the opening level of the first container. The method comprising the steps of:

Providing the first container with an open end including an edge structure.

Hingedly attaching an apertured cover to the edge.

Rotating the hingedly attached cover between a closed position and an opened position relative to the opening.

Lifting the second container and the material contained therein from the the lower level to rest upon the opened cover and transferring the material into first container.

The method could also include the step of providing a ramped surface extending from the hingedly attached cover. Additionally, the method could include the step of resting the opened cover on the ramped surface.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1A:
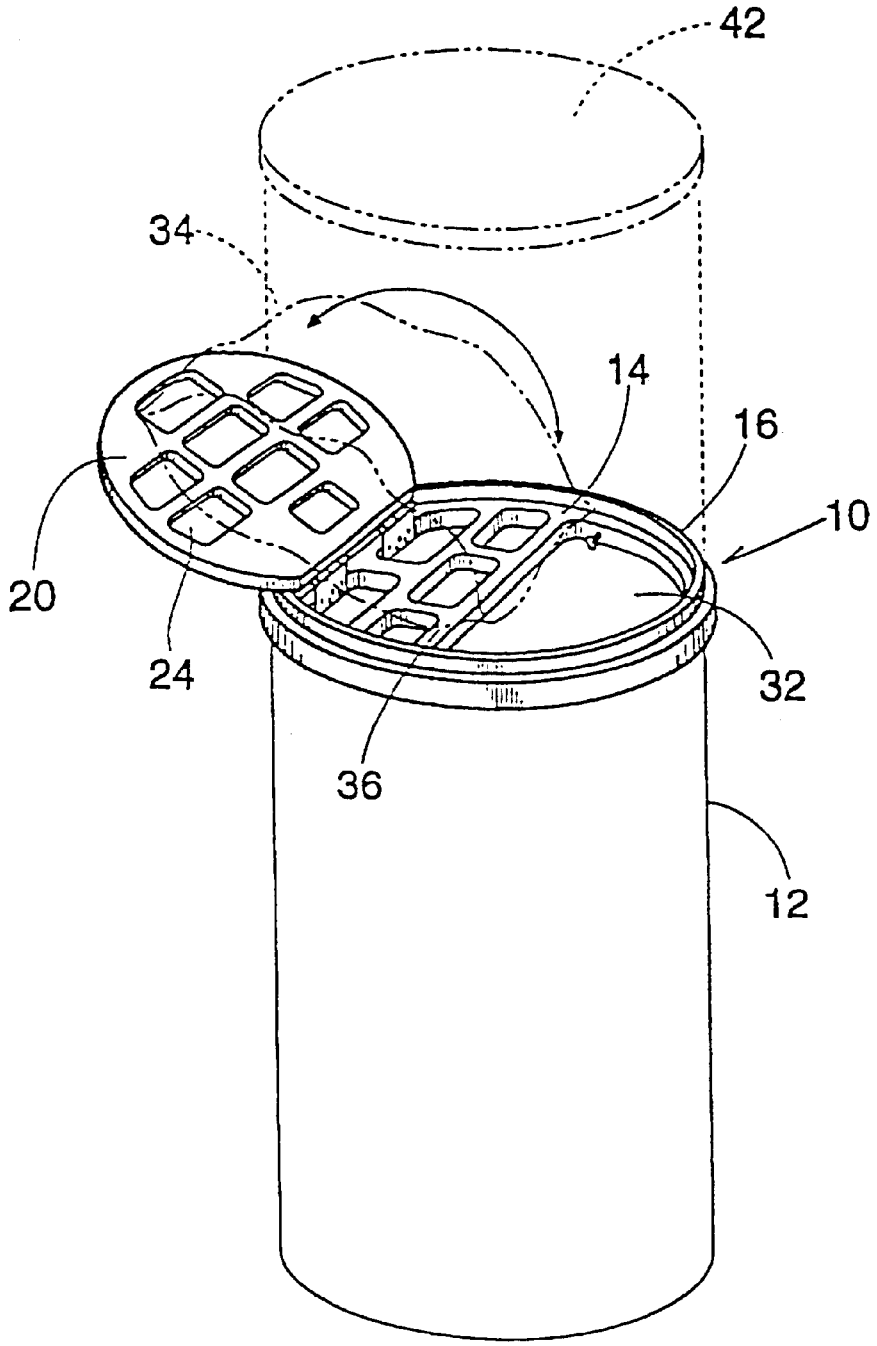
FIG. 1*a* is a perspective view of the container loader ledge fitment of the present invention installed upon a conventional water softener brine tank with material to be loaded shown in phantom.
Figure 1B:
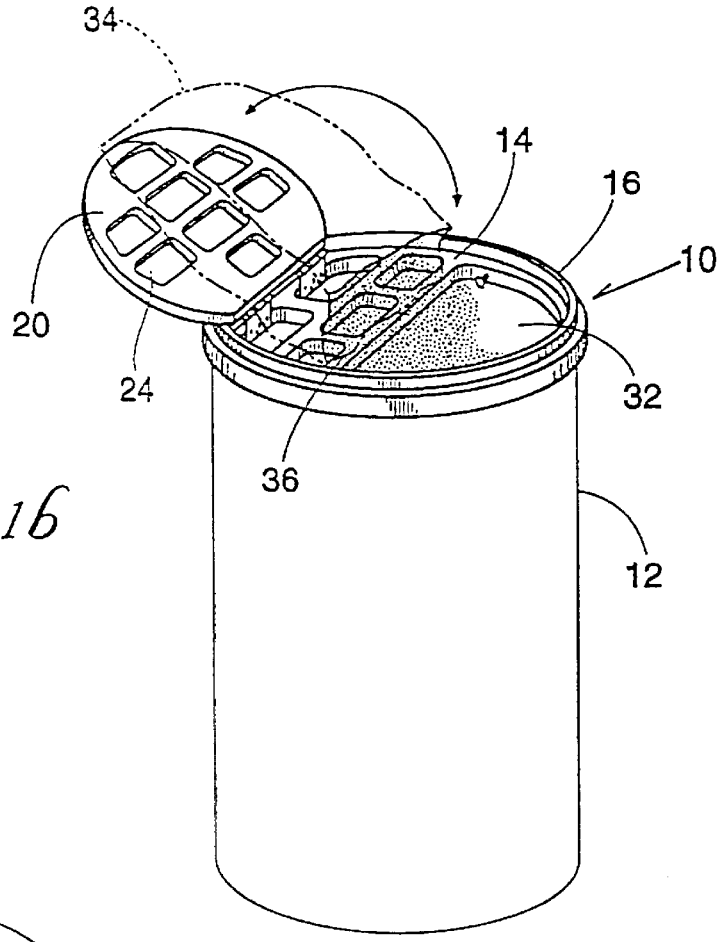
FIG. 1*b* is a perspective view of the container loader ledge fitment of the present invention installed upon a conventional water softener brine tank with the material in phantom being loaded into the container.
Figure 1C:
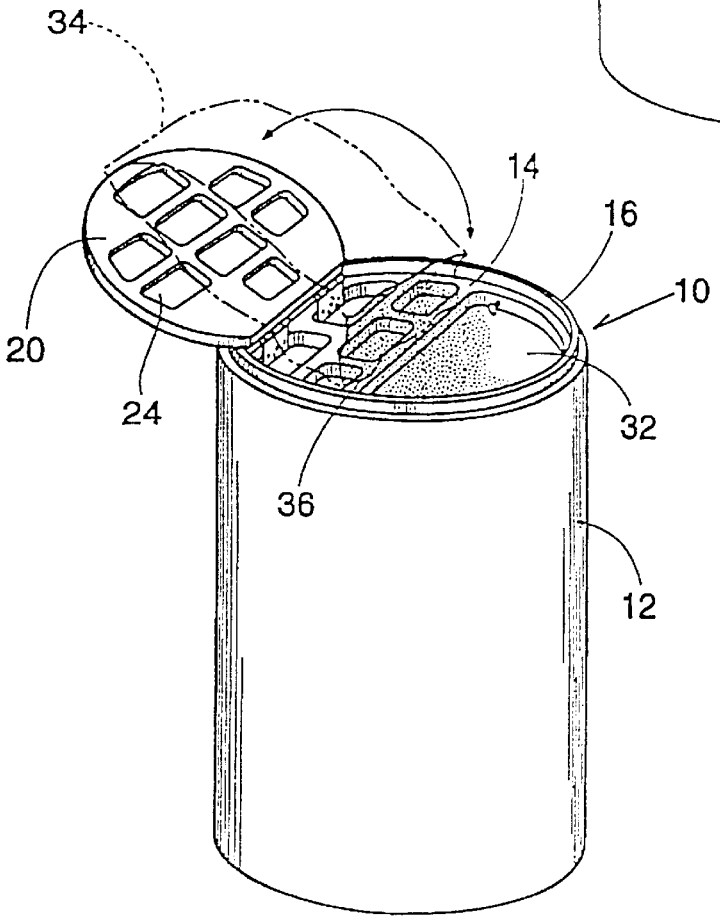
FIG. 1*c* is a prespective view of the container loader ledge fitment of the present invention in combination with a conventional water softner brine tank showing the material being loaded in phantom.
Figure 2A:
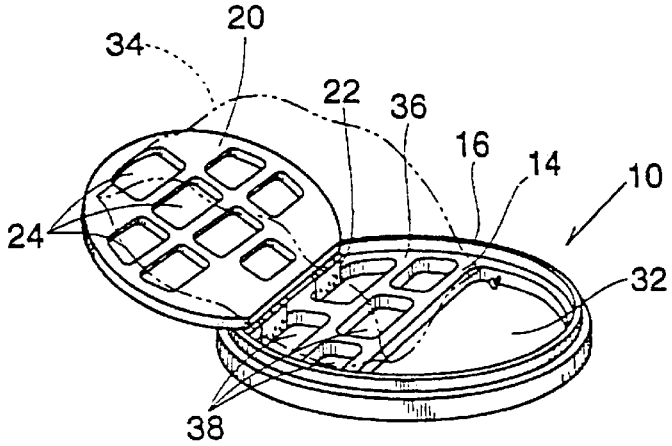
FIG. 2*a* is an enlarged perspective view of the loader ledge fitment of the present invention with the cover shown in the open position and material to be loaded shown in phantom.
Figure 2B:
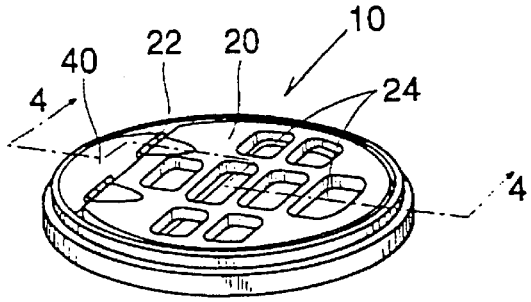
FIG. 2*b* is an enlarged perspective view of the loader ledge fitment of the present invention with the cover shown in the closed position.
Figure 4:
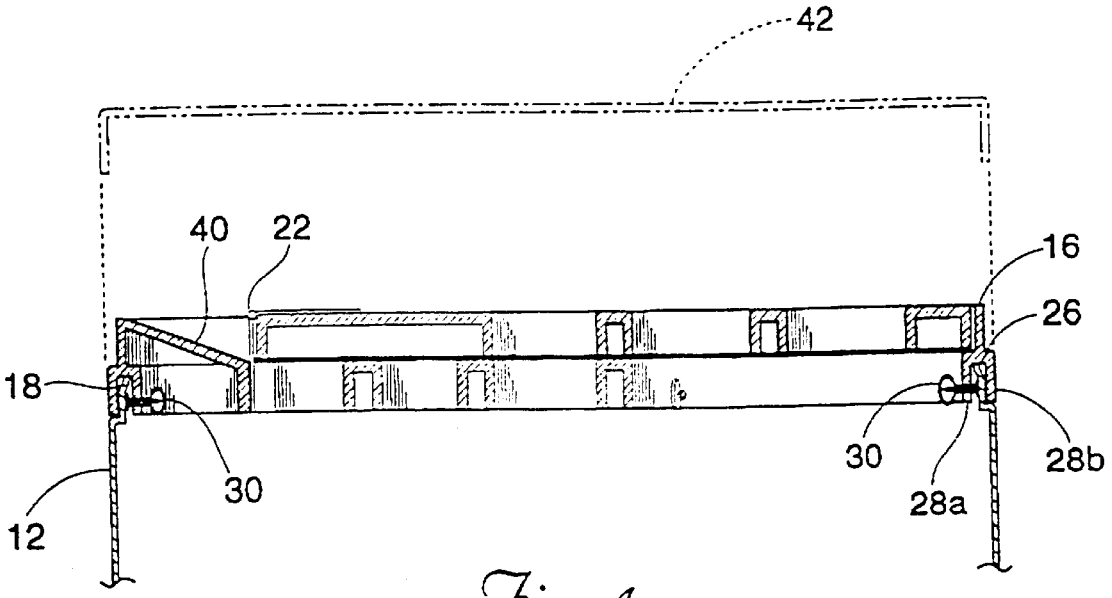
FIG. 4 is a cross sectional side view of the loader ledge fitment of the present invention, taken along line 4—4 of FIG. 2*b* and showing the cover, also illustrated in the views of FIGS. 1*a,* 1*b,* and 2*a,* in the closed position with the lid shown in phantom.

With particular reference to FIG. 1*a,* the container loader ledge fitment 10 of the present invention is adapted to be removably seated on a container 12, e.g., a conventional water softener brine tank. Although any material having appropriate characteristics may be used, the fitment 10 is preferably molded of a conventional plastic material, or in the alternative, the fitment 10 may be fabricated from a machined plywood sheet. Alternatively, as seen in FIG. 1*c,* the fitment may be integrally molded with a container 12. The fitment 10 defines a planar surface 14 having a peripheral portion 16 formed there about. Peripheral portion 16 is engagable with the edge 18 of tank 12, as is best seen in FIG. 4, or, as seen in FIG. 1*c* integrally molded to the container 12. The loader ledge fitment 10 may further comprise a cover 20 hingedly attached to the planar surface 14. Hinging means, seen as conventional double-leaf hinges 22, permit the cover 20 to be rotated between an opened position, seen in FIG. 2*a,* and a closed position as seen in FIG. 2*b.* Accordingly, it should be understood that a variety of different hinging means could be used in conjunction with the present invention including, but not limited to, cup and ball hinges, pintle hinges, double pintle hinges, spring hinges, gate hinges, multiple hinges with one bolt, and link hinges.

Further, in a preferred embodiment, the cover 20 may be provided with apertures 24. Apertures 24 permit the fitment 10 to be made with less manufacturing material, while retaining the necessary rigidity and strength to support heavy material-laden containers. The fitment 10 includes a major aperture 32 for receiving the materials supported on the opened cover. Aperture 32, as shown in FIGS. 1*a,* 1*b,* and 2*a* is preferably relatively enlarged to receive the salt or other bagged material. Referring particularly to FIG. 1*b,* the material 34 is seen being transferred into the container 12 through the aperture 32. (Shown in phantom as the reference numeral 34). However, as will be apparent to a person of ordinary skill in the art after reading this disclosure, aperture 32 may be composed of one or more openings and said aperture 32 need only be large enough to allow passage of the salt or other bagged material 34 that is to be transferred into the container 12.

Figure 2C:
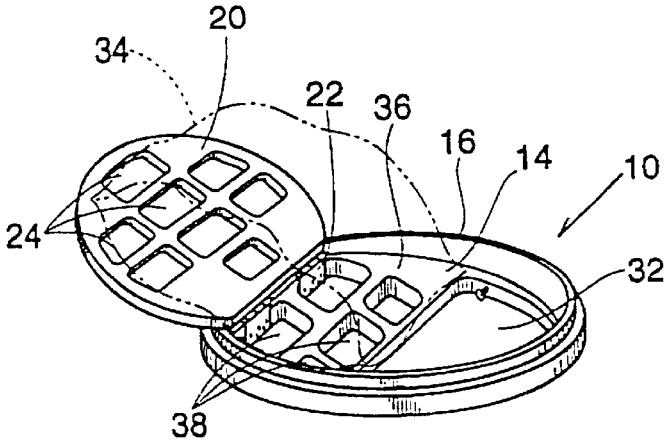
FIG. 2*c* is an enlarged perspective view of the loader ledge fitment of the present invention but showing an alternate, downwardly angled support web.

The invention contemplates resting the material 34, (seen in phantom) on top of the opened cover 20 where the contents may be poured through the major aperture 32 and supporting web 36, as seen in FIG. 1*b.* The supporting web 36 is provided with apertures 38 to provide strength and permit additional passageway for the poured material 34. In order to accomplish this feature, a ramp 40 is provided to support the opened cover 20 and the bagged material 34 resting thereon. Further, as seen in FIG. 2*c,* the supporting web 36 may be optionally angled downward to provide enhanced pouring of material 34. After the material has been poured into the container 12, the hinged cover 20 is rotated to the closed position until further loading is desired. As seen in phantom in FIGS. 1*a* and 4, a conventional lid 42, as supplied by the container manufacturer, may be placed directly over the fitment 10 when the fitment 10 is not in loading use.

Figure 3:
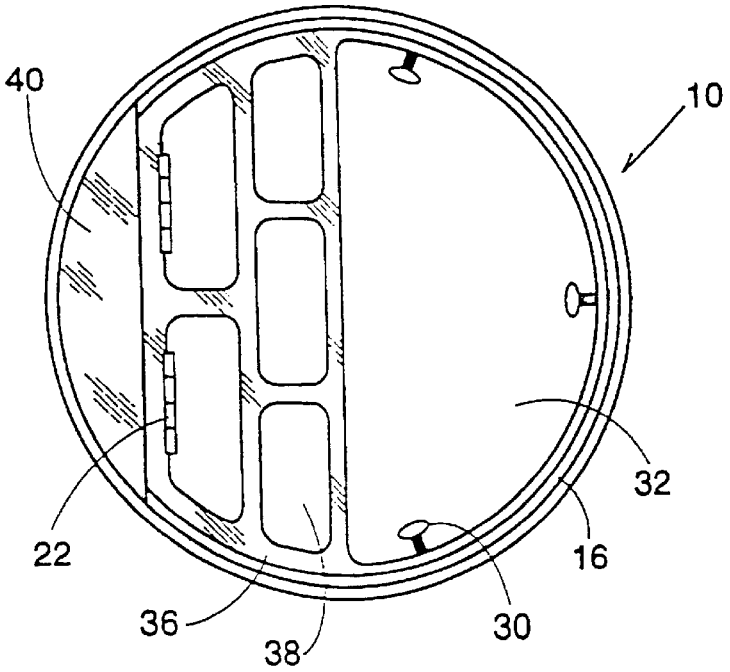
FIG. 3 is an enlarged top plan view of the loader ledge fitment of the present invention with the cover removed for ease of viewing.

With particular reference to FIG. 4, it can be seen that the peripheral portion 16 of loader fitment 10 is further provided with a circumferential channel 26 adapted to engagingly receive the edge 18 of tank 12. The channel 26 is generally U-shaped in cross section and includes a pair of oppositely disposed upstanding curbs 28*a,* 28*b.* The channel 26 is further provided with at least one attachment means, seen as thumb screws 30 in FIGS. 3 and 4. It is to be understood that although the preferred attachment means includes conventional, manually operated thumb screws, any disengagable attachment means able to securely attach the fitment against the tank 12 edge 18 may be used.

Figure 5A:
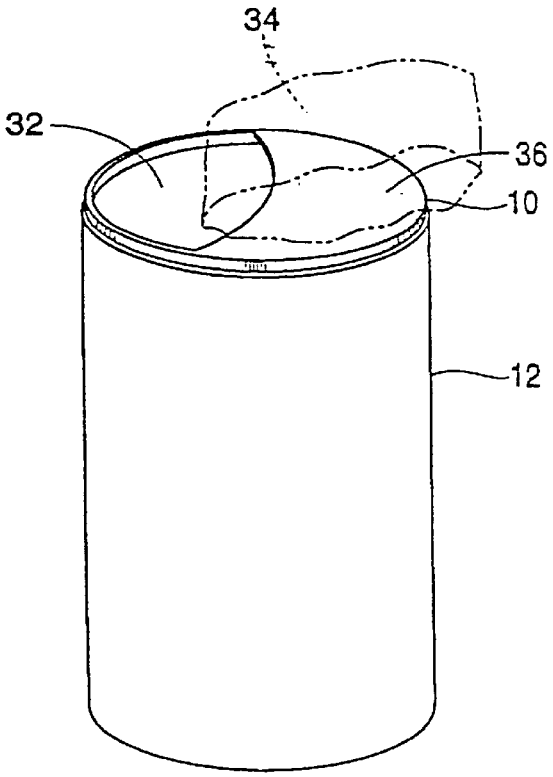
FIG. 5*a* is a perspective view illustrating an alternative embodiment of the present invention in combination with a container and the material to be loaded shown in phantom.
Figure 5B:
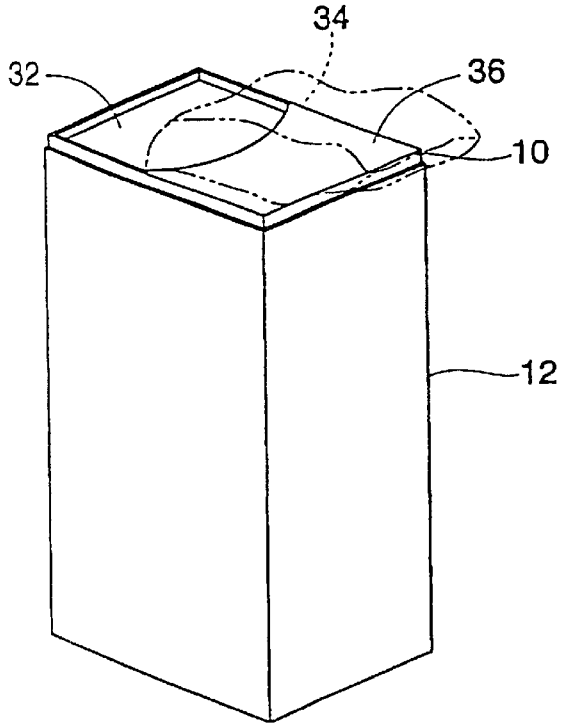
FIG. 5*b* is a perspective view illustrating an alternative embodiment of the present invention in combination with a container and the material to be loaded shown in phantom.
Figure 6A:
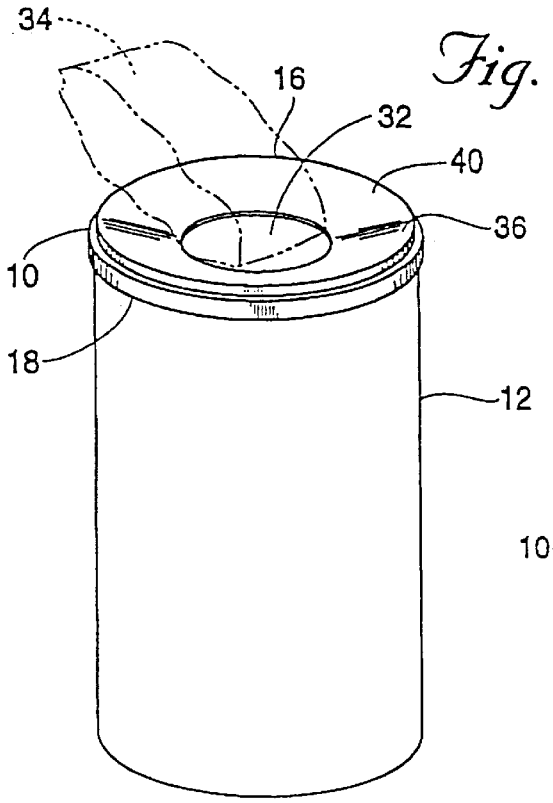
FIG. 6*a* is a perspective view illustrating an alternative embodiment of the present invention in combination with a container and the material to be loaded shown in phantom.
Figure 6B:
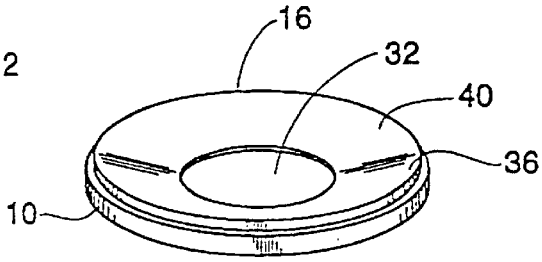
FIG. 6*b* is a perspective view of the alternative embodiment of the present invention disclosed in FIG. 6*a*.
Figure 6C:
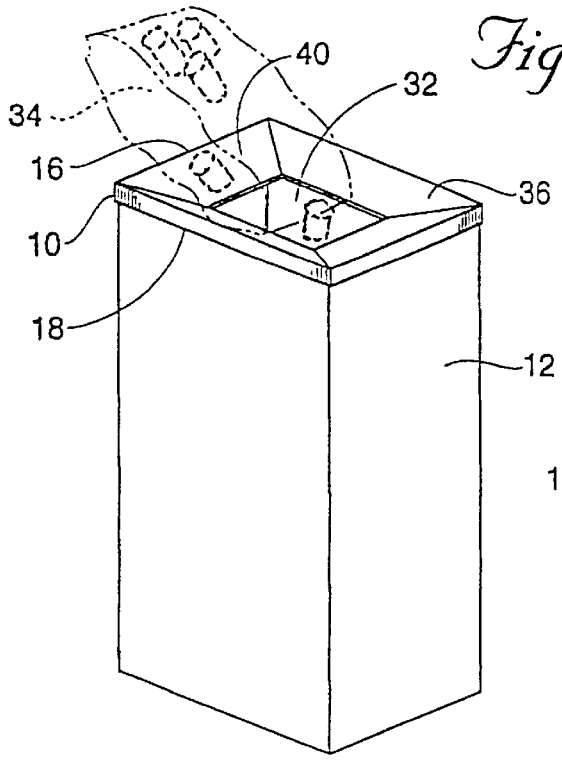
FIG. 6*c* is a perspective view illustrating an alternative embodiment of the present invention in combination with a container and the material to be loaded shown in phantom.
Figure 6D:
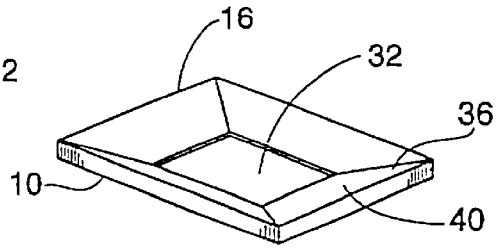
FIG. 6*d* is a perspective view of the alternative embodiment of the present invention disclosed in FIG. 6*c*.

Alternatively, referring to FIGS. 5*a* and 5*b,* the present invention may be practiced simply by providing a fitment 10 that comprises a supporting web or structure 36 and an aperture or opening 32. The shape of the fitment 10 being adapted to conform to shape of the container 12 with which the fitment 10 is designed to be used. Likewise the aperture 32 may be of any functionally desired shape or design.

Accordingly, as alternatively illustrated in FIGS. 6*a* through 6*d* the fitment 10 may be further modified so that the aperture 32 is more centrally located and the support structure 36 includes a ramp 40 which is circumjacent the aperture 32 and extends along a downward slope of the ramp 40 from peripheral portion 16 to aperture 32. The optional downward slope of the ramp 40 enhances unloading of the predetermined material 34, seen as cans in these views, through the aperture 32. Again, the shape of the fitment 10 may be adapted to conform to shape of the container 12 with which the fitment 10 is designed to be used. Likewise, as previously noted, the aperture 32 may be of any functionally desired shape or design. It is to be understood that, while the Figures show a removable fitment, it is within the scope of this invention to include fitments, which are integrally formed with the container to be filled.

Figure 7A:
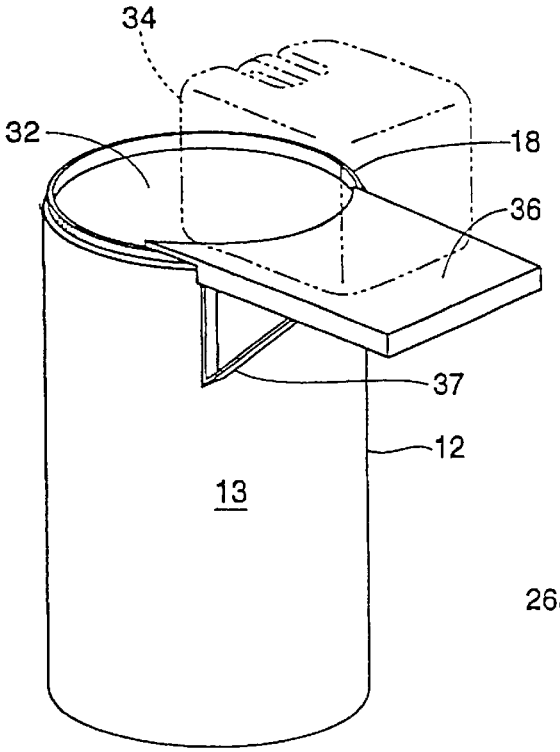
FIG. 7*a* is a perspective view illustrating an alternative embodiment of the present invention in combination with a container and the material to be loaded shown in phantom.
Figure 7B:
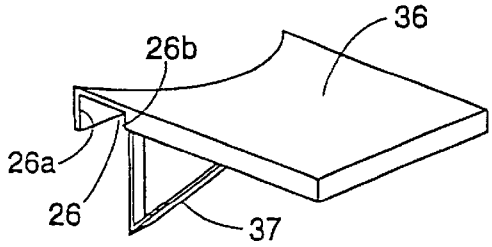
FIG. 7*b* is a perspective view illustrating an alternative embodiment of the present invention disclosed in FIG. 7*a*.
Figure 7C:
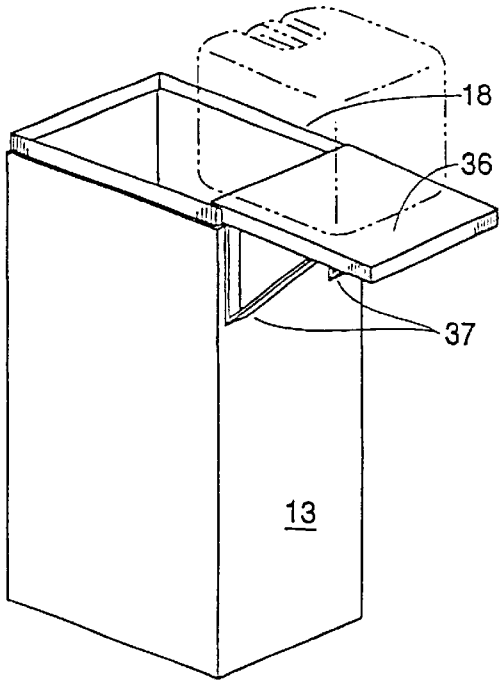
FIG. 7*c* is a perspective view illustrating an alternative embodiment of the present invention in combination with a container and the material to be loaded shown in phantom.
Figure 7D:
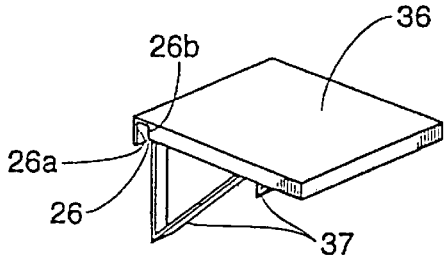
FIG. 7*d* is a perspective view illustrating an alternative embodiment of the present invention disclosed in FIG. 7*c*.

Referring now to FIGS. 7*a* through 7*d* another alternative embodiment of the invention is illustrated. In these embodiments the container 12 may, again be of any functional shape desired and the fitment 10 is designed to functionally engage the shape of the container 12. The fitment 10 includes a channel 26 having curbs 28*a* and 28*b*. The channel 26 is designed to conform to the shape of edge 18 and extends along and engages a predetermined portion of the edge 18 of the container 12. Brackets 37 are provided to engage a predetermined side 13 of the container 12 and provide support for the supporting web 36 and material to be supported which is integral to the channel 26 and coupled to the brackets 37. In the views of FIGS. 7*a* and 7*c*, the web 36 is seen supporting a liquid material 34, by way of example. The supporting web 36 may be easily removed from the container 12 by simply lifting the supporting web 36 and disengaging the channel 26 from the edge 18.

Figure 8A:
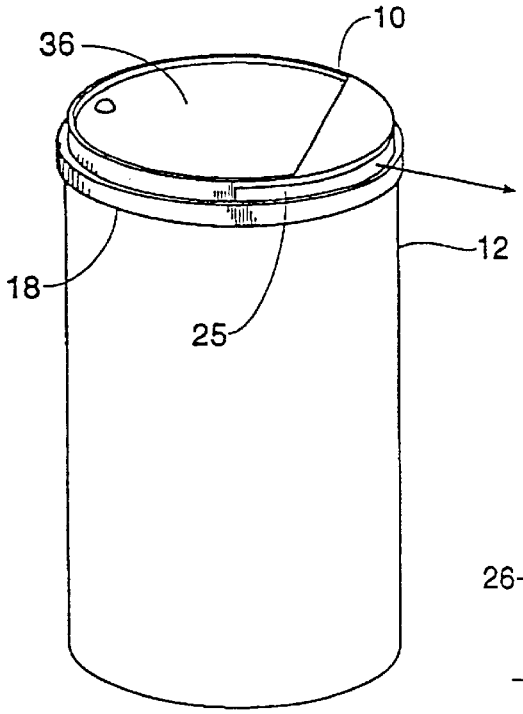
FIG. 8*a* is a perspective view illustrating an alternative embodiment of the present invention in combination with a container.
Figure 8B:
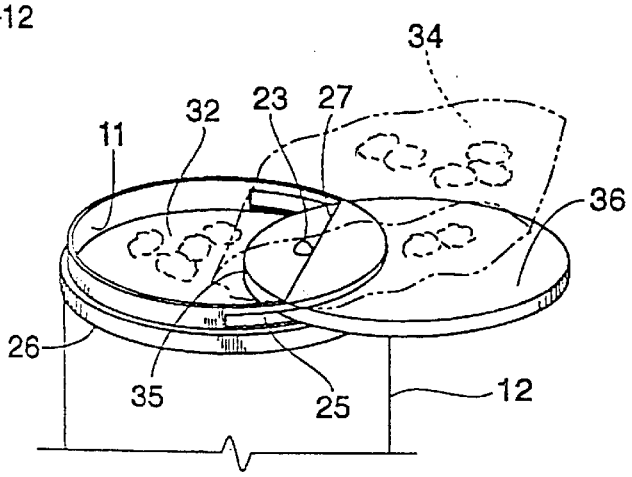
FIG. 8*b* is a perspective view illustrating the alternative embodiment disclosed in Figure and the material to be loaded shown in phantom.
Figure 8C:
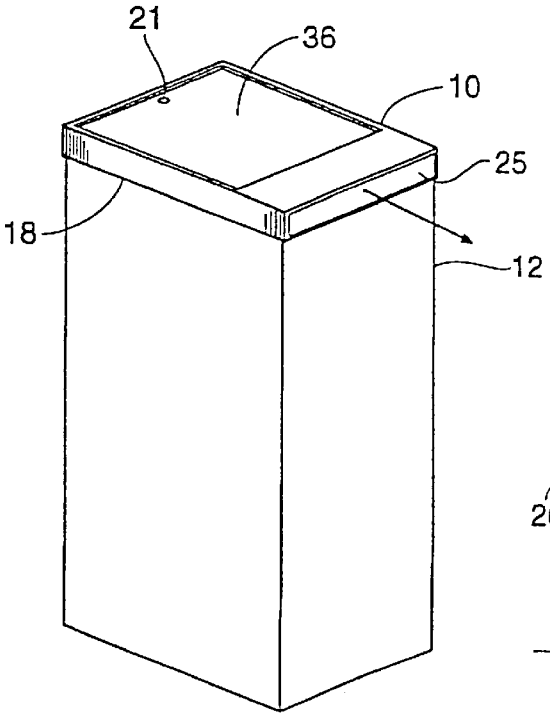
FIG. 8*c* is a perspective view illustrating an alternative embodiment of the present invention in combination with a container.
Figure 8D:
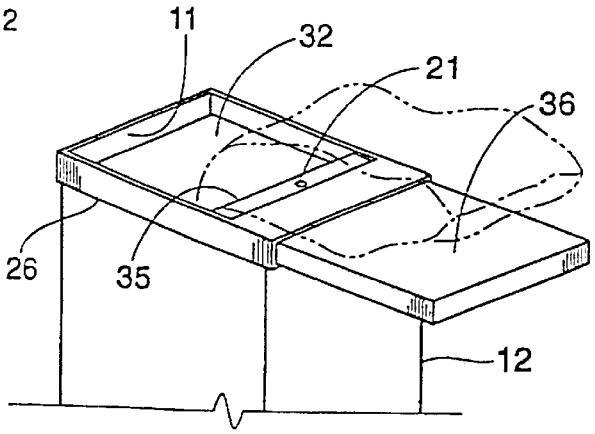
FIG. 8*d* is a perspective view illustrating the alternative embodiment of the present invention disclosed in FIG. 8*c* and the material to be loaded shown in phantom.
Figure 9A:
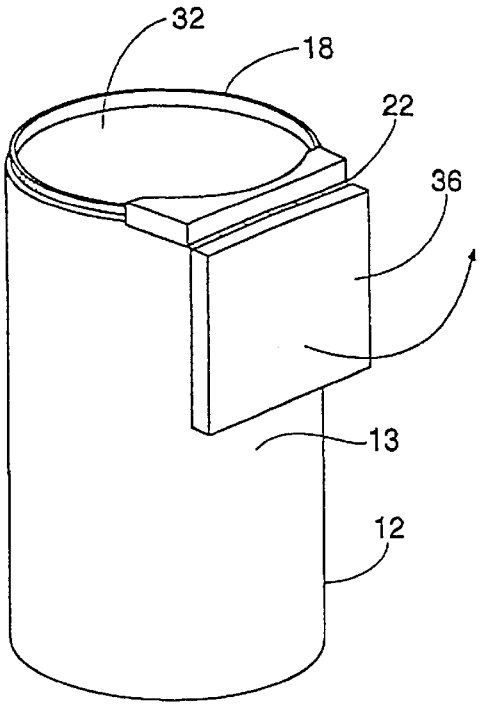
FIG. 9*a* is a perspective view illustrating an alternative embodiment of the present invention in combination with a container.
Figure 9B:
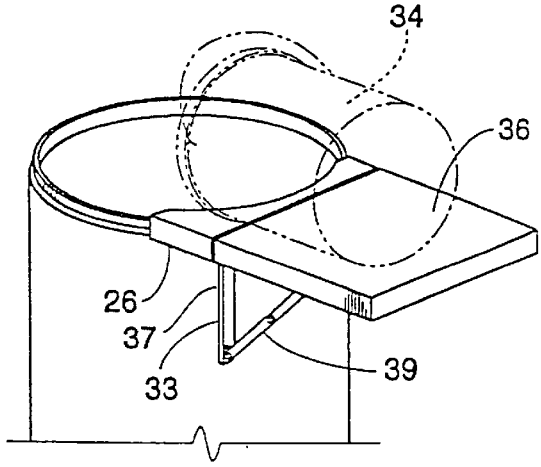
FIG. 9*b* is a perspective view illustrating the alternative embodiment of the present invention disclosed in FIG. 9*a* and the material to be loaded shown in phantom.
Figure 9C:
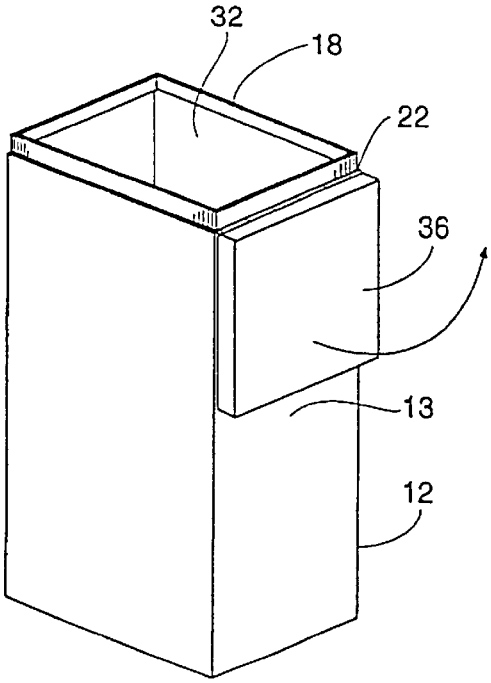
FIG. 9*c* is a perspective view illustrating an alternative embodiment of the present invention in combination with a container.
Figure 9D:
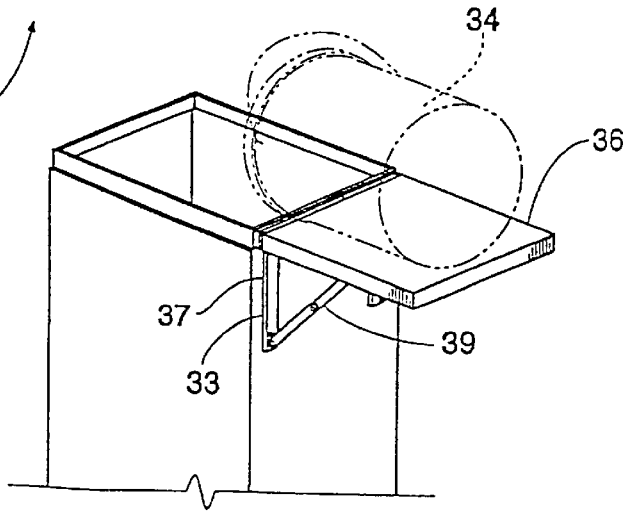
FIG. 9*d* is a perspective view illustrating the alternative embodiment of the present invention disclosed in FIG. 9*c* and the material to be loaded shown in phantom.
Figure 10A:
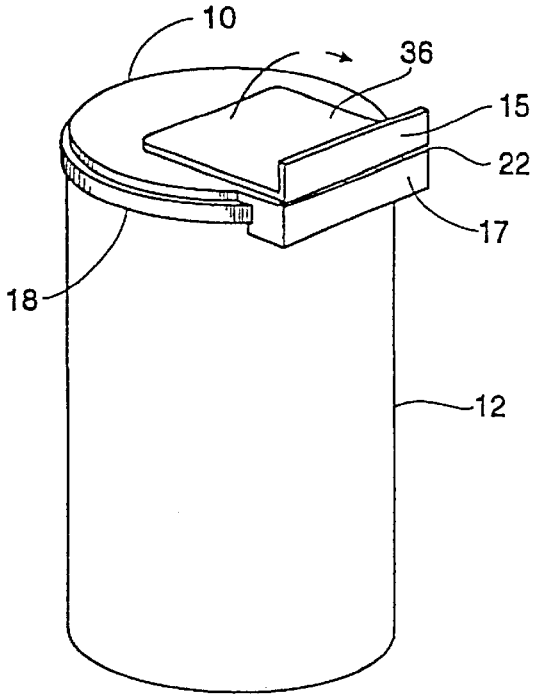
FIG. 10*a* is a perspective view illustrating an alternative embodiment of the present invention in combination with a container.
Figure 10B:
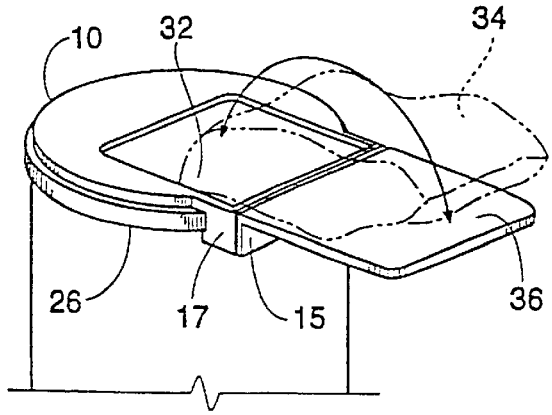
FIG. 10*b* is a perspective view illustrating the alternative embodiment of the present invention disclosed in FIG. 10*a* and the material to be loaded shown in phantom.
Figure 10C:
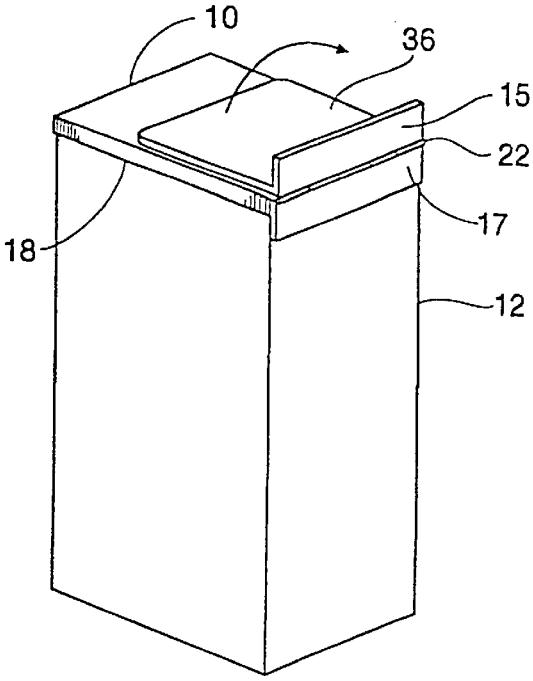
FIG. 10*c* is a perspective view illustrating an alternative embodiment of the present invention in combination with a container.
Figure 10D:
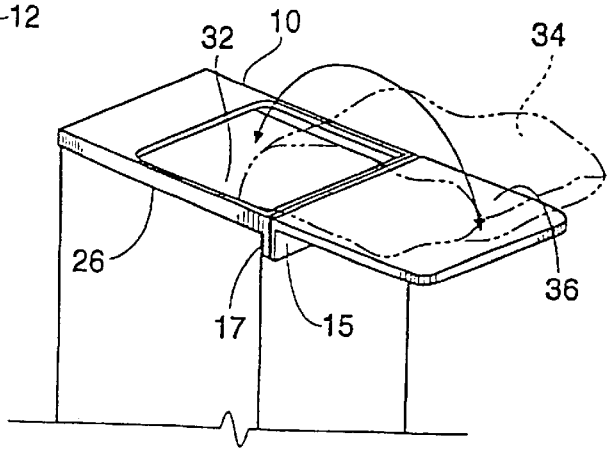
FIG. 10*d* is a perspective view illustrating the alternative embodiment of the present invention disclosed in FIG. 10*c* and the material to be loaded shown in phantom.
Figure 11A:
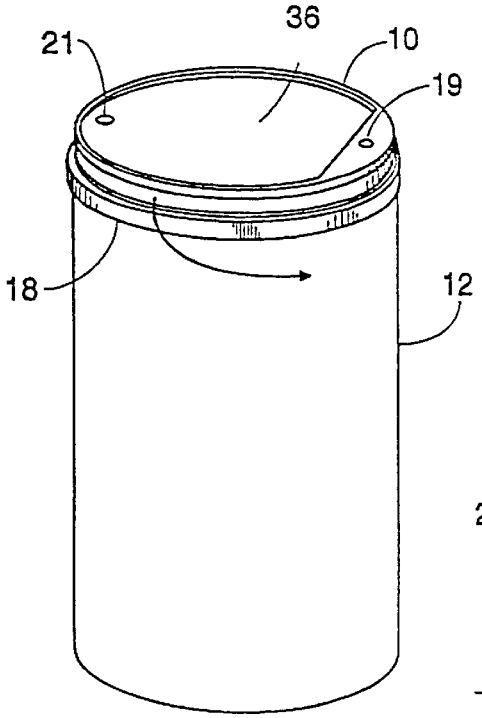
FIG. 11*a* is a perspective view illustrating an alternative embodiment of the present invention in combination with a container.
Figure 11B:
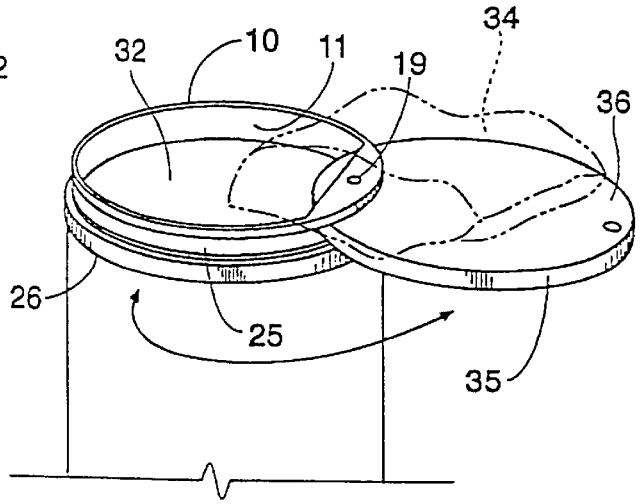
FIG. 11*b* is a perspective view illustrating the alternative embodiment of the present invention disclosed in FIG. 11*a* and the material to be loaded shown in phantom.
Figure 11C:
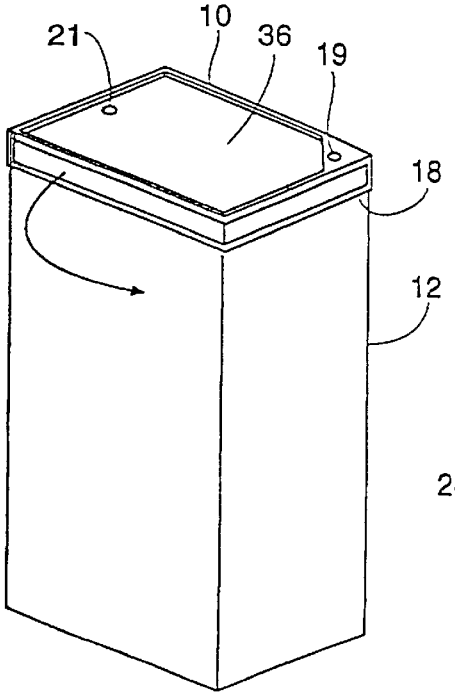
FIG. 11*c* is a perspective view illustrating an alternative embodiment of the present invention in combination with a container.
Figure 11D:
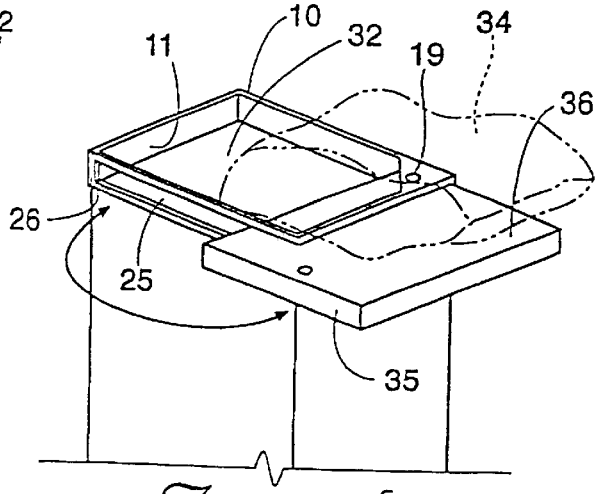
FIG. 11*d* is a perspective view illustrating the alternative embodiment of the present invention disclosed in FIG. 11*c* and the material to be loaded shown in phantom.
Figure 12A:
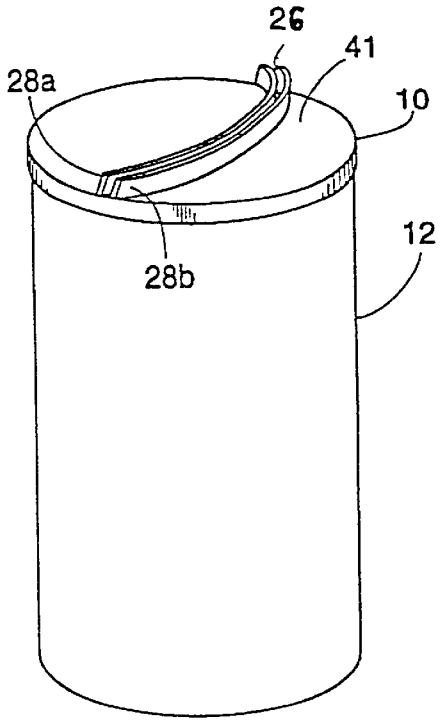
FIG. 12*a* is a perspective view illustrating an alternative embodiment of the present invention in combination with a container.
Figure 12B:
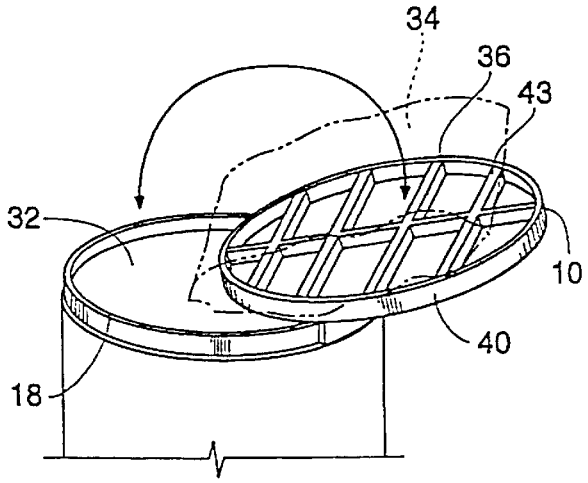
FIG. 12*b* is a perspective view illustrating the alternative embodiment of the present invention disclosed in FIG. 12*a* and the material to be loaded shown in phantom.
Figure 12C:
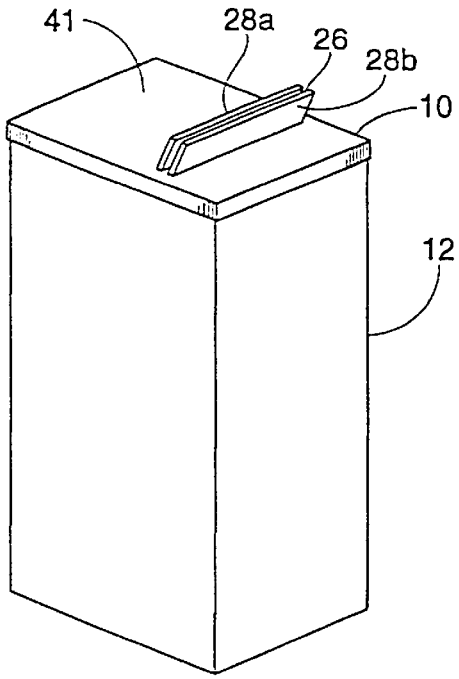
FIG. 12*c* is a perspective view illustrating an alternative embodiment of the present invention in combination with a container.
Figure 12D:
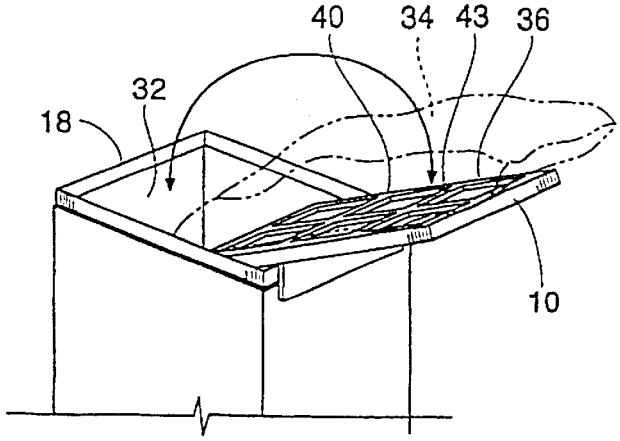
FIG. 12*d* is a perspective view illustrating the alternative embodiment of the present invention disclosed in FIG. 12*c* and the material to be loaded shown in phantom.

Referring now to FIGS. 8*a* through 8*d* another alternative embodiment of the present invention is disclosed. As previously noted, the container 12 may be of any functional shape desired and the fitment 10 is designed to functionally engage the shape of the container 12. In this embodiment channel 26 is designed to conform to the shape of edge 18 and extends along and engages the edge 18 of the container 12. Fitment 10 is provided with a slot 25. Slot 25 is of sufficient size to allow the supporting web 36 to be extended and retracted through it. When supporting web 36 is extended through slot 25 aperture 32 is presented and the material 34 to be deposited may be rested. In these views, the material 34 is seen as stones or other heavy particles. When supporting web 36 is retracted through slot 25 so that its edge 35 abuts inner wall 11 of the fitment 10 aperture 32 is closed and the container 12 is covered. Referring to FIGS. 8*a* and 8*b* the supporting web 36 may be seen to include a boss or key structure 23. Boss 23 is provided to allow the user a handle or knob to grasp and to act as a stop to engage aperture edge 27 and prevent supporting web 36 from being completely extended through the slot 25. Alternatively, referring to FIGS. 8*c* and 8*d*, supporting web 36 may simply be provided an opening 21 that may be grasped by the user to aid in extending the supporting web 36 through the slot 25. In the embodiment disclosed in FIGS. 8*c* and 8*d* there is no stop to engage aperture edge 27 and prevent supporting web 36 from being completely extended through the slot 25. Alternatively, referring to FIGS. 8*a*–8*d*, the fitment 10 may be integrally formed with the container 12.

Referring now to FIGS. 9*a* through 9*d* another alternative embodiment of the invention is illustrated. In these embodiments the container 12 may, again be of any functional shape desired and the fitment 10 is designed to functionally engage the shape of the container 12. The fitment 10 includes a channel 26. The channel 26 is designed to conform to the shape of edge 18 and extends along and engages a predetermined portion of the edge 18 of the container 12. Alternatively, the fitment 10 may be integral to the edge 18 of the container 12. Brackets 37 are provided to engage a predetermined side 13 of the container 12 and provide support for the supporting web 36, which is coupled to channel 26 at hinge 22. The brackets 37 further include lockable collapsible lever arms 39, which extend from supporting web 36 to bracket arm 33 of the bracket 37. The supporting web 36 may be easily removed from the container 12 by simply disengaging the channel 26 from the edge 18 of the container 12. The supporting web 36 is coupled to the brackets 37 and may be swung up from the down position disclosed in FIGS. 9*a* and 9*c* to the up position disclosed in FIGS. 9*b* and 9*d* on hinge 22. Lever arms 39 may be locked in place when the supporting web 36 is in the up position and a load may be placed on the supporting web 36.

Referring now to FIGS. 10*a* through 10*d* another alternative embodiment of the present invention is disclosed. In these embodiments the container 12 may, again be of any functional shape desired and the fitment 10 is designed to functionally engage the shape of the container 12. The fitment 10 includes a channel 26. The channel 26 is designed to conform to the shape of edge 18 and extends along and engages the edge 18 of the container 12. Alternatively, the fitment 10 may be integral to the edge 18 of the container 12. In this embodiment the fitment 10 is hingedly coupled to the supporting web 36 at hinge 22. The supporting web 36 includes a stop 15. The fitment 10 includes an abutment 17. Supporting web 36 may be rotated on hinge 22 so that stop 15 engages abutment 17. This mechanical action presents aperture 32 and put supporting web 36 in position for a load to be placed upon it. After the load, e.g., a bag (seen in phantom as reference numeral 34) containing material such as salt, sand, etc. has been emptied into the container 12 the supporting web 36 may be rotated back on hinge 22 so that aperture 32 is covered.

Referring now to FIGS. 11*a* through 11*d* another alternative embodiment of the invention is illustrated. In these embodiments the container 12 may, again be of any functional shape desired and the fitment 10 is designed to functionally engage the shape of the container 12. The fitment 10 includes a channel 26. The channel 26 is designed to conform to the shape of edge 18 and extends along and engages the edge 18 of the container 12. Alternatively, the fitment 10 may be integral to the edge 18 of the container 12. Fitment 10 is provided with a slot 25. Supporting web 36 is rotatably coupled to the fitment 10 at hinge pin 19. Slot 25 is of sufficient size to allow the supporting web 36 to be rotated on hinge pin 19 and extended out of slot 25 and retracted back through slot 25. When supporting web 36 is extended through slot 25 aperture 32 is presented. When supporting web 36 is retracted through slot 25 so that its edge 35 abuts inner wall 11 of the fitment 10 aperture 32 is closed and the container 12 is covered. The supporting web 36 may further include an opening 21 that may be grasped by the user to aid in extending the supporting web 36 through the slot 25. Once the supporting web 36 is rotated into the open position so that aperture 32 is presented, supporting web 36 in position for a load to be placed upon it. After the load of material 34 (seen in phantom as e.g., a bag containing material such as salt, sand, etc.), has been emptied into the container 12 the supporting web 36 may be rotated back on hinge pin 19 through slot 25 so that aperture 32 is covered.

Referring now to FIGS. 12*a* through 12*d* another alternative embodiment of the invention is illustrated. In these embodiments the container 12 may, again be of any functional shape desired and the fitment 10 is designed to functionally engage the shape of the container 12. The fitment 10 includes a channel 26 having curbs 28*a* and 28*b*. The channel 26 is located on fitment surface 41 and is designed to conform to and be engagable with the shape or contour of a predetermined portion of edge 18. Preferably, but not necessarily, curbs 28*a* and 28*b* have predetermined pitch, which imparts an angle to channel 26. Accordingly, the fitment 10 may be removed from covering the container 12 and channel 26 may be engaged with edge 18 so that fitment bottom surface 43 and aperture 32 are presented. Because the pitch of curbs 28*a* and 28*b* imparted a pitch to channel 26 supporting web 36 is tilted at a downward angle to aperture 32. Consequently, supporting web 36 presents a ramp 40, which aids in the transference of a load placed upon supporting web 36 from supporting web 36 into the container 12 through aperture 32.

Figure 13A:
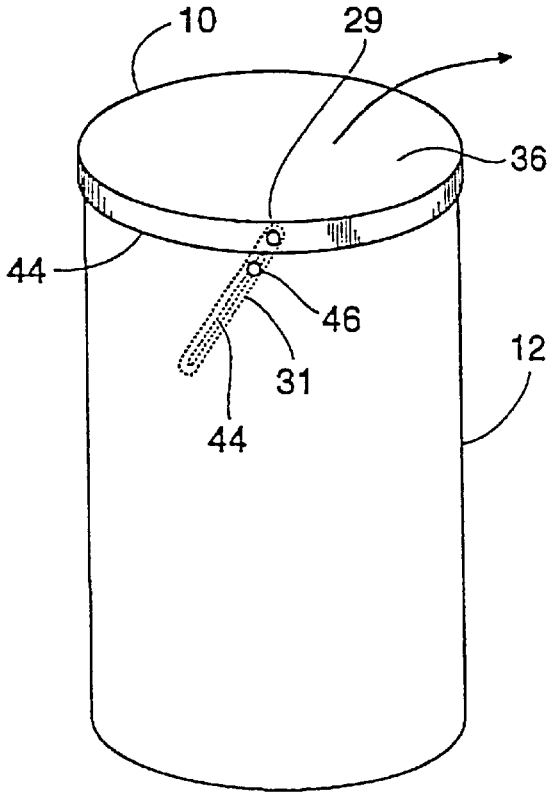
FIG. 13*a* is a perspective view illustrating an alternative embodiment of the present invention in combination with a container.
Figure 13B:
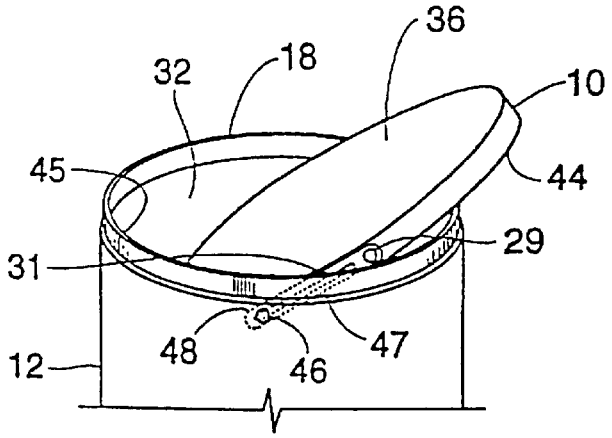
FIG. 13*b* is a perspective view illustrating the alternative embodiment of the present invention disclosed in FIG. 13*a*.

Referring now to FIGS. 13*a* through 13*b* another alternative embodiment of the invention is illustrated. In these embodiments the container 12 may, again be of any functional shape desired and the fitment 10 is designed to functionally engage the shape of the container 12. The fitment 10 has an inside rim surface 44. The container 12 has an inside surface 45. A lockable collapsible bracket 31 is coupled to the inside rim surface 44 of the fitment 10 at hinge pin 29 and to the container 12 at bearing pin 46. Bearing pin 46 is slidably engaged to bracket 31 in slot 47. Fitment 10 is pivotally coupled to bracket 31 at hinge pin 29. Fitment 10 may be lifted off of edge 18 of container 12 until pin 46 engages distal end 48 of the slot 47. Fitment 10 may then be pivoted on hinge pin 29 so that aperture 32 is exposed and supporting web 36 engages a portion of edge 18 of the container at an angle sufficient to act as a ramp 40, which aids in the transference of a load placed upon supporting web 36 from supporting web 36 into the container 12 through aperture 32.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A method of transferring a material into a first container from a second container, and wherein the material and its second container is lifted from a different level to the opening level of said first container, said method comprising the steps of:

providing the first container with an open end including an edge structure;

providing a supporting apertured planar surface member having a peripheral portion formed thereabout, said peripheral portion engagable with said edge structure;

hingedly attaching an apertured cover to said planar surface member, said apertured cover arranged to rest upon said surface member;

providing a ramped surface extending laterally outwardly from said planar surface member;

rotating said hingedly attached cover to an opened position relative to said opening;

supporting said rotated opened cover on said ramped surface;

lifting said second container and the material contained therein from the said different level to rest upon the opened cover and said apertured planar surface; and transferring said material into said first container.

2. The method of claim 1 wherein said material is salt.

3. The method of claim 1 wherein said material is a liquid.

4. The material of claim 1 wherein said material is sand.

5. The method of claim 1 wherein said material comprises articles to be sorted.

6. A method of transferring a material into a first container from a second container, and wherein the material and its second container is lifted from a different level to the opening level of said first container; said method comprising the steps of:

providing the first container with an open end including an edge structure;

integrally forming a supporting apertured planar surface member having a peripheral portion formed thereabout with said edge;

providing said apertured planar surface with an apertured cover having a rotatable hinge;

providing a ramped surface extending laterally outwardly from said planar surface member;

rotating said hinged cover to an opened position relative to said opening;

supporting said rotated opened cover on said ramped surface;

lifting said second container and the material contained therein from the said different level to rest upon the opened cover and transferring said material into said first container.

7. The method of claim 6 wherein said material is salt.

8. The method of claim 6 wherein said material is a liquid.

9. The material of claim 6 wherein said material is sand.

10. The method of claim 6 wherein said material comprises articles to be sorted.

11. A method of transferring a material into a first container from a second container, and wherein the material and its second container is lifted from a different level to the opening level of said first container, said method comprising the steps of:

providing the first container with an open end including an edge structure;

providing a supporting apertured planar surface member having a peripheral portion formed thereabout, said peripheral portion engagable with said edge structure;

hingedly attaching a cover to said planar surface member, said cover arranged to rest upon said surface member;

providing a ramped surface extending laterally outwardly from said planar surface member;

rotating said hingedly attached cover to an opened position relative to said opening;

supporting said rotated opened cover on said ramped surface;

lifting said second container and the material contained therein from the said different level to rest upon the opened cover and said apertured planar surface; and transferring said material into said first container.

12. A method of transferring a material into a first container from a second container, and wherein the material and its second container is lifted from a different level to the opening level of said first container; said method comprising the steps of:

providing the first container with an open end including an edge structure;

integrally forming a supporting apertured planar surface member having a peripheral portion formed thereabout with said edge;

providing said apertured planar surface with a cover having a rotatable hinge;

providing a ramped surface extending laterally outwardly from said planar surface member;

rotating said hinged cover to an opened position relative to said opening;

supporting said rotated opened cover on said ramped surface; and lifting said second container and the material contained therein from the said different level to rest upon the opened cover and transferring said material into said first container.

13. A method of transferring a material into a first container from a second container, and wherein the material and its second container is lifted from a different level to the opening level of said first container; said method comprising the steps of:

providing the first container with an exterior and an open end, said open end including an edge structure;

integrally forming a supporting apertured planar surface member having a peripheral portion formed thereabout with said edge;

providing said apertured planar surface with a cover;

moving said cover to an opened position relative to said opening;

lifting said second container and the material contained therein from the said different level to rest upon the opened cover and transferring said material into said first container; and providing said peripheral portion with a slot having an opening, said cover capable of being extended and retracted through said slot; whereby when said cover is extended through said slot said opening is presented.

14. A method of transferring a material into a first container from a second container, and wherein the material and its second container is lifted from a different level to the opening level of said first container; said method comprising the steps of:

providing the first container with an open end including an edge structure;

providing a supporting apertured planar surface member having a peripheral portion formed thereabout, said peripheral portion engagable with said edge structure;

providing means for securing said peripheral portion to said edge;

providing said apertured planar surface with a cover;

moving said cover to an opened position relative to said opening;

lifting said second container and the material contained therein from the said different level to rest upon the opened cover and transferring said material into said first container; and providing said peripheral portion with a slot having an opening, said cover capable of being extended and retracted through said slot; whereby when said cover is extended through said slot said opening is presented.

15. A method of transferring a material into a first container from a second container, and wherein the material and its second container is lifted from a different level to the opening level of said first container; said method comprising the steps of:

providing the first container with an exterior and an open end, said open end including an edge structure;

integrally forming a supporting apertured planar surface member having a peripheral portion formed thereabout with said edge;

providing at least one bracket structure having at least a first end removably engagable to an exterior surface of said first container and at least a second end coupled to said peripheral portion; providing said at least one bracket with at least one lockable collapsible lever mechanism; and lifting said second container and the material contained therein from the said different level to rest upon the peripheral portion and transferring said material into said first container.

16. A method of transferring a material into a first container from a second container, and wherein the material and its second container is lifted from a different level to the opening level of said first container; said method comprising the steps of:

providing the first container with an exterior and an open end, said open end including an edge structure;

providing a supporting apertured planar surface member having a peripheral portion formed thereabout; said peripheral portion engagable with said edge structure;

providing at least one bracket structure having at least a first end removably engagable to an exterior surface of the said container and at least a second end coupled to said peripheral portion;

providing said bracket with at least one lockable collapsible lever mechanism; and lifting said second container and the material contained therein from the said different level to rest upon the peripheral portion and transferring said material into said first container.

17. The method of claim 16 further including the step of providing means for securing said peripheral portion to said edge.

18. A method of transferring a material into a first container from a second container, and wherein the material and its second container is lifted from a different level to the opening level of said first container; said method comprising the steps of:

providing said first container with a fitment comprising a supporting web, a slot, a hinge mechanism and a channel providing said first container with at least one open end including at least one edge structure;

engaging said channel with said edge structure;

rotatably coupling said supporting web to said fitment at said hinge structure;

providing said fitment with a slot, said slot having sufficient size and spatial orientation so that said supporting web may be rotated on said hinge mechanism and extended out of said slot and retracted back through said slot;

extending said supporting web through said slot to thereby present said opening;

placing said material and its second container on said supporting web; and transferring said material into said first container.

19. A method of transferring a material into a first container from a second container, and wherein the material and its second container is lifted from a different level to the opening level of said first container; said method comprising the steps of:

providing said first container with at least one open end including at least one edge structure;

providing said first container with a fitment, said fitment including a supporting web surface and a channel;

providing said channel with a plurality of curb structures having a predetermined pitch and spatially orientated to impart a predetermined angle to said channel;

locating said channel on a first fitment surface substantially opposite said supporting web surface;

presenting at least a portion of said open end by engaging said channel with at least one portion of said edge structure;

placing said material and its second container on said supporting web; and transferring said material into said first container.

* * * * *